US006397753B2

(12) United States Patent
Keenan et al.

(10) Patent No.: US 6,397,753 B2
(45) Date of Patent: Jun. 4, 2002

(54) WATER-BASED APPARATUS TO MITIGATE DAMAGE AND INJURIES FROM A FULLY OR PARTIALLY CONFINED EXPLOSION

(75) Inventors: William A. Keenan, Ventura; Phillip C. Wager, Hueneme, both of CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/956,741

(22) Filed: Sep. 17, 2001

Related U.S. Application Data

(63) Continuation of application No. 09/436,714, filed on Nov. 8, 1999, now Pat. No. 6,289,816.

(51) Int. Cl.[7] ..... F42D 5/00; F42B 3/00

(52) U.S. Cl. ..... 102/303; 102/301; 102/323; 102/324

(58) Field of Search ..... 102/301, 303, 102/323, 324

(56) References Cited

U.S. PATENT DOCUMENTS

| | | | | | |
|---|---|---|---|---|---|
| 3,945,319 | A | * | 3/1976 | Meagher | 102/303 |
| 4,836,079 | A | * | 6/1989 | Barrett | 102/303 |
| 5,482,754 | A | * | 1/1996 | Crook | 102/303 X |
| 6,161,462 | A | * | 12/2000 | Michaelson | 102/303 |
| 6,302,026 | B1 | * | 10/2001 | Parkes | 102/303 |
| 6,332,401 | B1 | * | 12/2001 | Tota et al. | 102/301 X |

* cited by examiner

*Primary Examiner*—Peter A. Nelson
(74) *Attorney, Agent, or Firm*—David Kalmbaugh

(57) ABSTRACT

A water-based apparatus for mitigating the gas pressure loading and associated damage and injuries from a fully or partially confined explosion. The water-based apparatus comprises a water-blanket which rests on each pallet of ordnance to mitigate the gas pressure loading from an inadvertent explosion of the ordnance. The water-blanket includes a pair of storage modules, each module comprising a plurality of water storage compartments that store a predetermined quantity of water which is dependent upon the type and quantity of explosive in the ordnance on the pallet. The storage modules are joined by a zipper which allows the modules to be separated for ease in transport.

11 Claims, 14 Drawing Sheets

WATER-BASED APPARATUS TO MITIGATE DAMAGE AND INJURIES FROM A FULLY OR PARTIALLY CONFINED EXPLOSION

This Application is a continuation of U.S. patent application Ser. No. 09/436,714, and now U.S. Pat. No. 6,289,816, filed Nov. 8, 1999.

BACKGROUND OF THE INVENTION

1. Field of the Invention

The present invention relates generally to apparatus for mitigating damage and injuries from an explosion inside a confined space, such as an explosion inside an ammunition storage magazine, a missile test cell, a missile maintenance facility, a bomb disposal vessel, a command and control center, or like structures. More particularly, the present invention relates to a water-filled blanket which may be deployed inside a structure to mitigate the gas pressure loading generated by an explosion inside the structure confining the explosion.

2. Description of the Prior Art

Explosive devices, such as projectiles, bombs, and missiles stored in an ordnance facility, will occasionally detonate accidentally, resulting in an explosion which may cause substantial damage and injuries. If the mass, strength and architecture of the structure are sufficient to fully or partially confine the explosion, then the by-products of the explosion will cause the buildup of high temperature gases. These high temperature gases, when expanding in a space with restricted venting, cause the buildup of gas pressures inside the facility. The magnitude of the peak gas pressure depends primarily on the type and weight of the explosive relative to the interior volume of the facility. The duration and total impulse of the gas pressure depend primarily on the degree of venting available for these gases to escape from the facility. The degree of venting, in turn, depends on the total area of openings in the building envelope, the volume of space in the building for the hot gases to expand into, the mass and strength of the building envelope, and the magnitude and location of the maximum credible explosion (MCE) inside the facility. The degree of confinement and venting in most weapons facilities is sufficient to produce a significant gas pressure loading inside the facility. Such a loading could cause a significant increase in the extent of damage and injuries inside and outside the weapons facility.

Most ordnance facilities used for the production, maintenance, assembly and repair of weapons are conventional unhardened, above-ground buildings. These ordnance buildings must be located a large distance from nearby inhabited facilities in order to limit the risk of injuries and damage from hazardous debris produced by the maximum credible explosion (MCE) in the ordnance facility.

Generally, the minimum safe separation distance from an ordnance facility encumbers a large area of land. For example, the minimum safe separation distance to inhabited facilities from an ordnance facility is 1,250 feet for an MCE (Maximum Credible Event)≦30,000 pounds NEW (Net Explosive Weight). Thus, an ordnance facility containing less than 30,000 pounds NEW, a typical situation, encumbers 112 acres of land which is the area of a circle with a 1,250 feet radius. The minimum safe separation distance and encumbered land area are, in turn, dictated by the maximum strike range of hazardous fragments and debris. At today's real estate prices, especially near the waterfront, the value of encumbered land often exceeds the acquisition cost of the ordnance facility.

The minimum safe separation distance from building debris is also dictated, in part, by the gas impulse developed when the explosion is confined by the building envelope. This gas impulse contributes significantly to the launch velocity of building debris and the resulting maximum strike range of hazardous debris. Thus, any device or method that significantly reduces the magnitude of this gas impulse would significantly reduce the maximum strike range of hazardous debris and the corresponding encumbered land area needed for the safety of people and property.

SUMMARY OF THE INVENTION

The present invention overcomes some of the difficulties of the traditional strategies for mitigating the effects of an explosion in that it comprises a relatively simple, yet highly effective water-based apparatus which mitigates the gas pressure loading developed inside the structure confining the explosion.

One embodiment of the present invention is a water-blanket which rests on each pallet of ordnance to mitigate the gas pressure loading from an inadvertent explosion of the ordnance. Each water-blanket includes a pair of storage modules with each module comprising a plurality of storage compartments for storing a predetermined quantity of water. The storage modules are joined by a zipper which allows the modules to be separated for ease in transport. The quantity of water in the water-blanket depends upon the type and quantity of explosive on each pallet, the total number of pallets, and the structural and venting characteristics of the surrounding facility.

DETAILED DESCRIPTION OF THE PREFERRED EMBODIMENT

Figure 1:
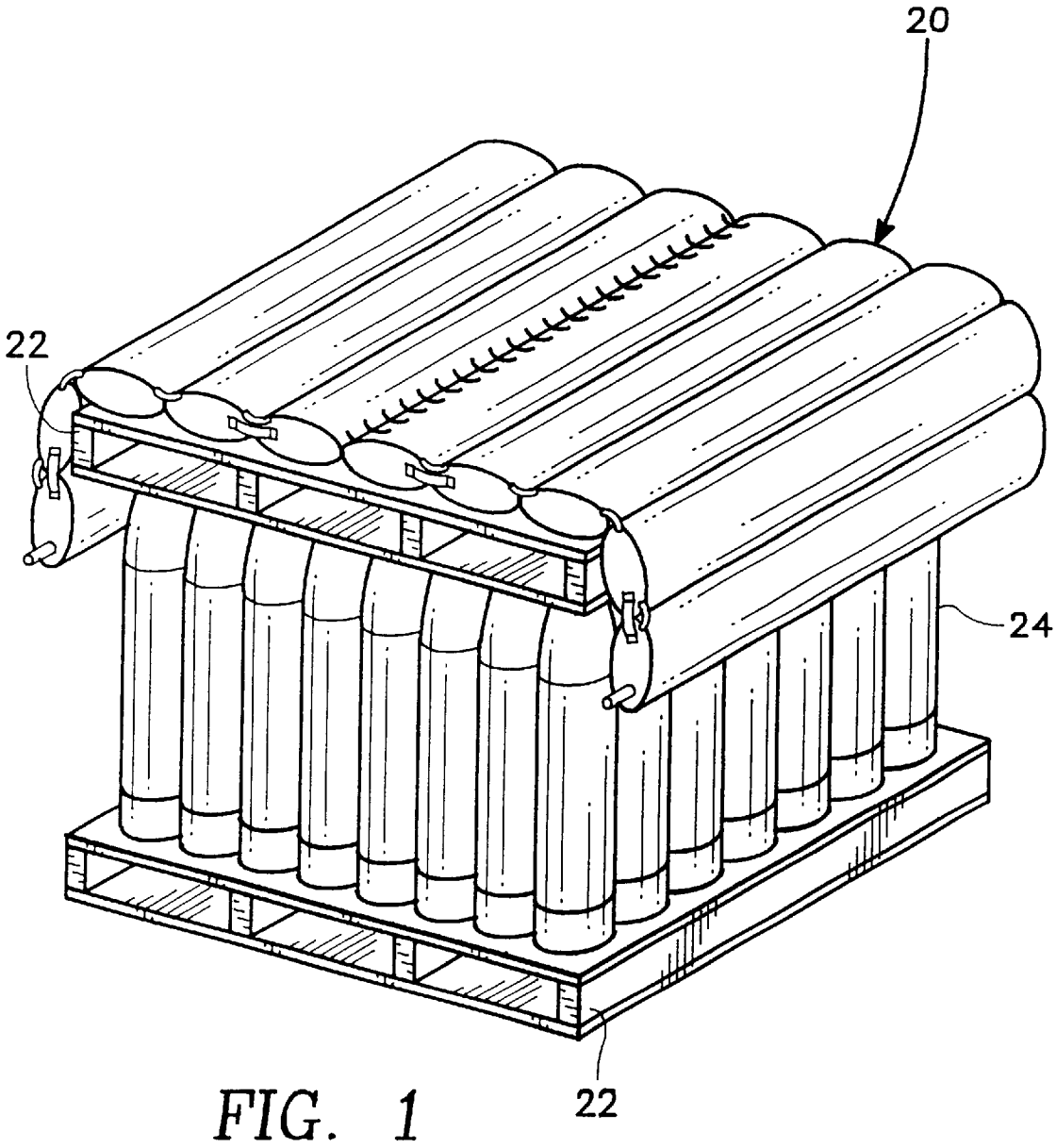
FIG. 1 is a perspective view of a water-blanket, constituting a preferred embodiment of the present invention when deployed on one or more pallets of ordnance.
Figure 2:
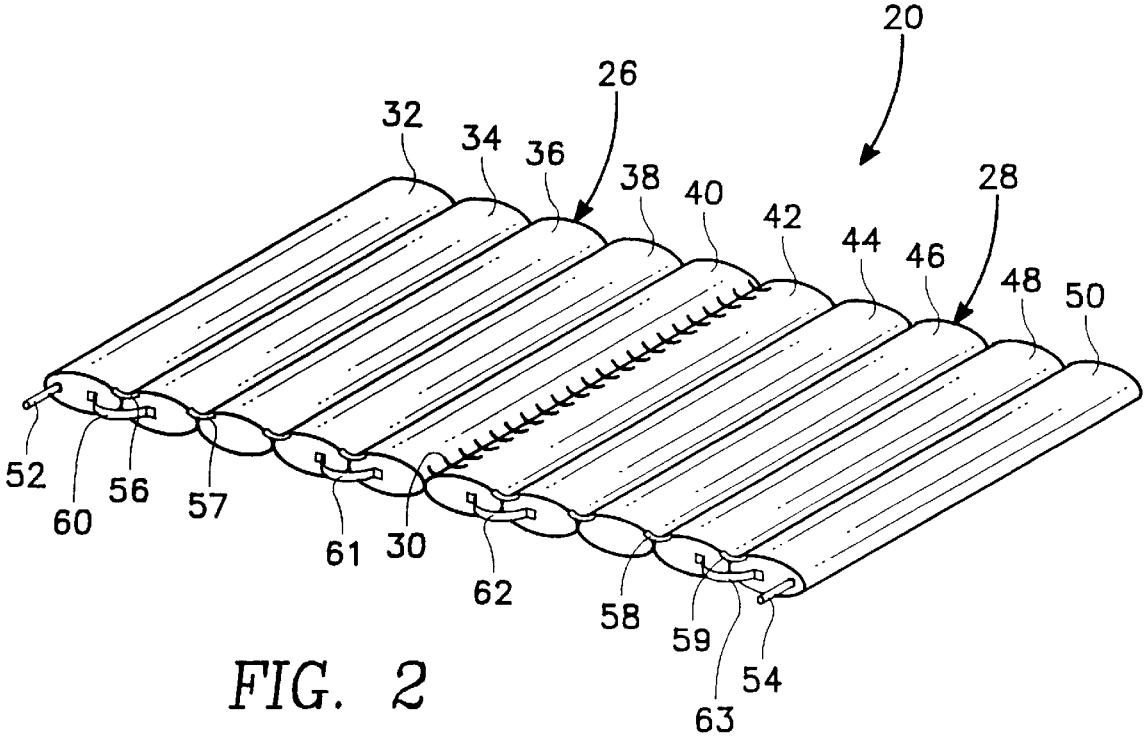
FIG. 2 is a detailed perspective view of the water-blanket of FIG. 1.
Figure 3:
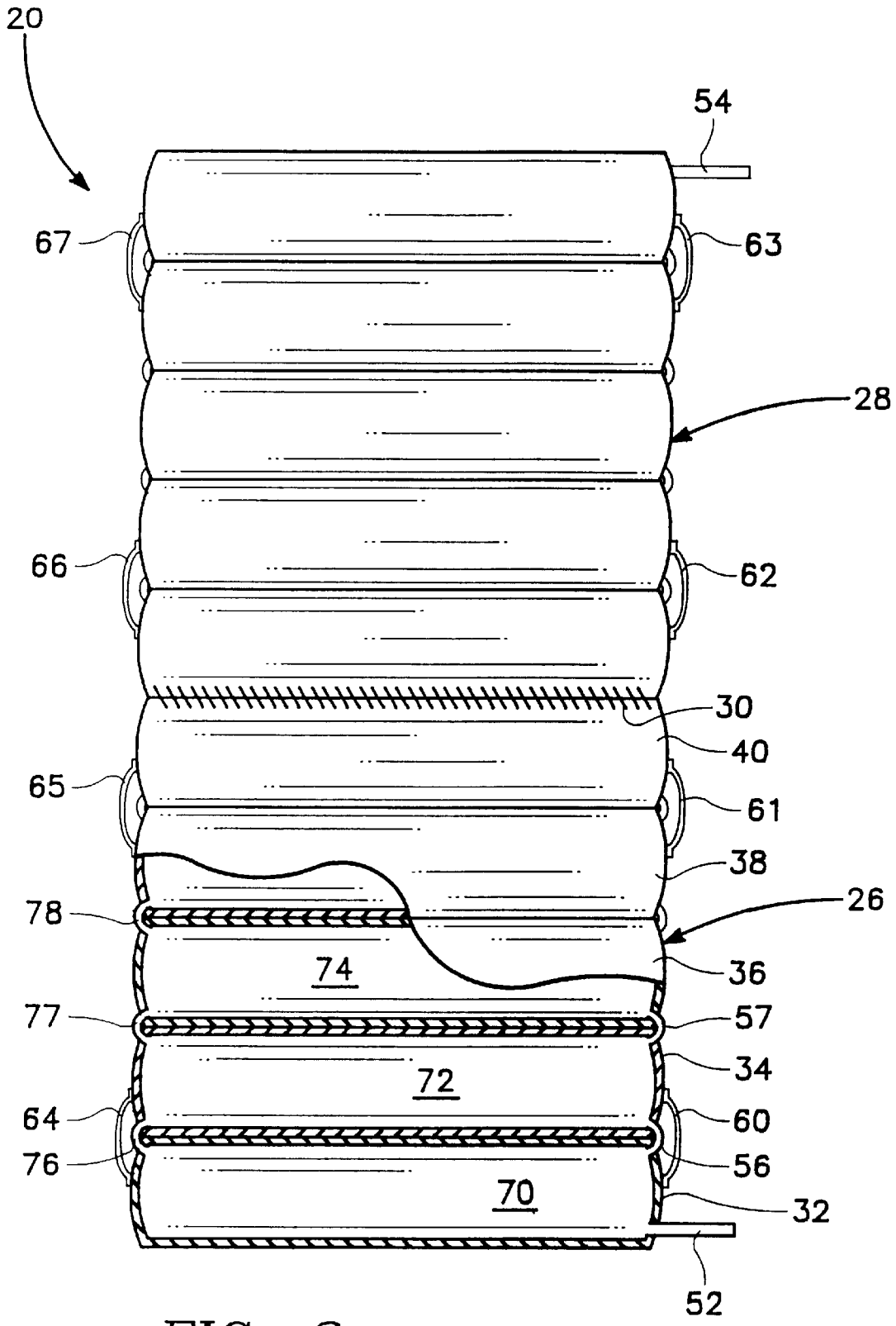
FIG. 3 is a view, partially in section, of the water-blanket of FIG. 1.

FIGS. 1, 2 and 3 illustrate a water-blanket, identified generally by the reference numeral 20, which constitutes a preferred embodiment of the present invention. As shown in FIG. 1, a water-blanket 20 is draped over projectiles 24 stored on a pallet 22 to mitigate the effects of an explosion should one or more of the projectiles 24 on pallet 22 detonate.

Water-blanket 20 includes a pair of storage modules 26 and 28 connected by a zipper 30. Each storage module 26 and 28 has five water storage compartments with module 26 comprising water storage compartments 32, 34, 36, 38 and 40 and module 28 comprising water storage compartments 42, 44, 46, 48 and 50. Attached to storage module 26 are four handles 60, 61, 64 and 65 which allow the user of water-blanket 20 to move storage module 26 from one location to another location within an ordnance facility after unzipping module 26 from module 28. Similarly, storage module 28 has four handles 62, 63, 66 and 67 attached thereto which allow the user of water-blanket 20 to move module 28 from one location to another location.

Water storage compartment 32 of module 26 includes a stem 52 which extends from compartment 32 and also communicates with a water storage chamber 70 formed within the interior of compartment 32 as shown in FIG. 3. The first pair of fluid passageways 56 and 76 connect water storage chamber 70 of compartment 32 to water storage chamber 72 of adjacent compartment 34. In a like manner, there is a second pair of fluid passageways 57 and 77 which connect water storage chamber 72 of compartment 34 to water storage chamber 74 of adjacent compartment 36.

Although only one fluid passageway 78 is illustrated in FIG. 3 as connecting chamber 74 of compartment 36 to the chamber for adjacent compartment 38, a second fluid passageway (not illustrated) also connects chamber 74 of compartment 36 to the chamber for adjacent compartment 38. There is also a pair of fluid passageways (not illustrated) which connect the water storage chamber of compartment 38 to the water storage chamber of adjacent compartment 40.

Stem 52 of module 26 allows the user of water-blanket 20 to fill compartments 32, 34, 36, 38 and 40 of module 26 with water and also allows the user of water-blanket 20 to drain water from compartments 32, 34, 36, 38 and 40 of module 26. Fluid passageways 56, 57, 76, 77 and 78 and identical fluid passageways (not illustrated) between adjacent compartments 38 and 40 allow for the transfer of water between adjacent compartments of module 26 of water-blanket 20.

Stem 54 of module 28 allows the user of water-blanket 20 to fill compartments 42, 44, 46, 48 and 50 of module 28 with water and also allows the user of water-blanket 20 to drain water from compartments 42, 44, 46, 48 and 50 of module 28. Each of these adjacent compartments of module 28 also contain a pair of fluid passageways (not illustrated) for the transfer of water between the compartments.

Based on the heat of vaporization of water and the heat of detonation of the explosive, such as TNT, the water-blanket 20 of FIG. 1 would require about 1.8 pounds of water for each pound of TNT explosive stored on pallet 22 to mitigate the effects of a confined explosion. For other high explosive materials, such as H-6, the water-blanket 20 would require about 3.8 pounds of water for each pound of H-6 explosive.

It should also be noted that the length and number of water-blankets 20 to be used with each pallet 22 will vary depending on the type and net explosive weight of the explosive stored on pallet 22. Water-blanket 20 will generally have a width slightly less than the length of any pallet of ordnance.

Figure 4A:
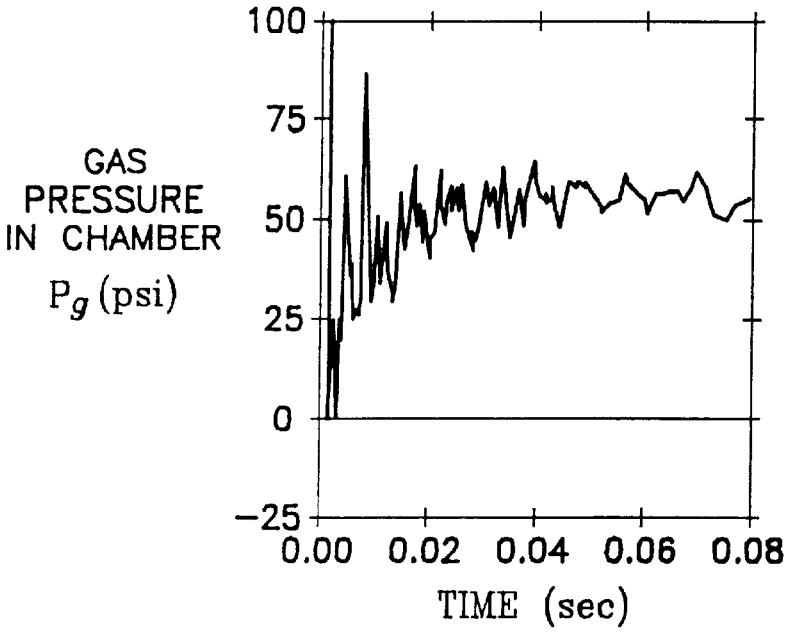
FIGS. 4A and 4B are graphs illustrating gas pressure versus time measured inside an unvented test chamber without water-filled blankets (FIG. 4A), and water filled blankets simulating three walls of a test cell (FIG. 4B)
Figure 4B:
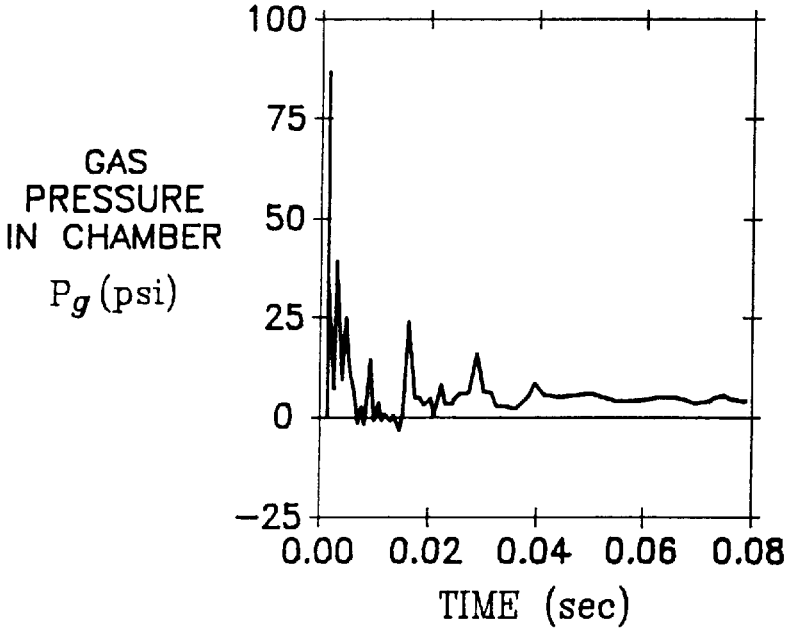

The plot in FIG. 4A shows as a function of time the gas pressure measured inside an unvented test facility without water-filled blankets operating as walls simulating three walls of a missile test cell. The plot in FIG. 4B, shows as a function of time the gas pressure measured inside the same unvented test facility but with water-filled blankets simulating three walls of a missile test cell. Each test used 4.67 pounds of TNT. With 13.5 pounds of water, the gas pressure was reduced 89% from 51.3 psi (FIG. 4A) to 5.8 psi (FIG. 4B). There was a similar reduction in the total gas impulse.

Figure 5A:
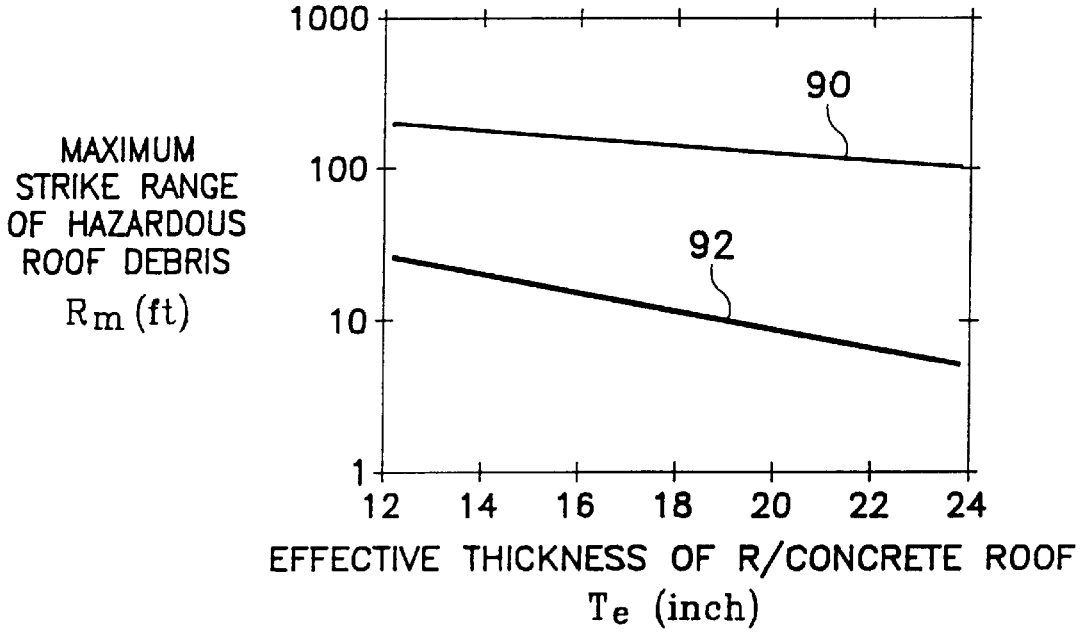
FIG. 5A is a graph illustrating the effect of a water-blanket on the maximum strike range of hazardous roof debris for a maximum credible explosion equal to 560 pounds NEW inside the facility illustrated in FIG. 5B.
Figure 5B:
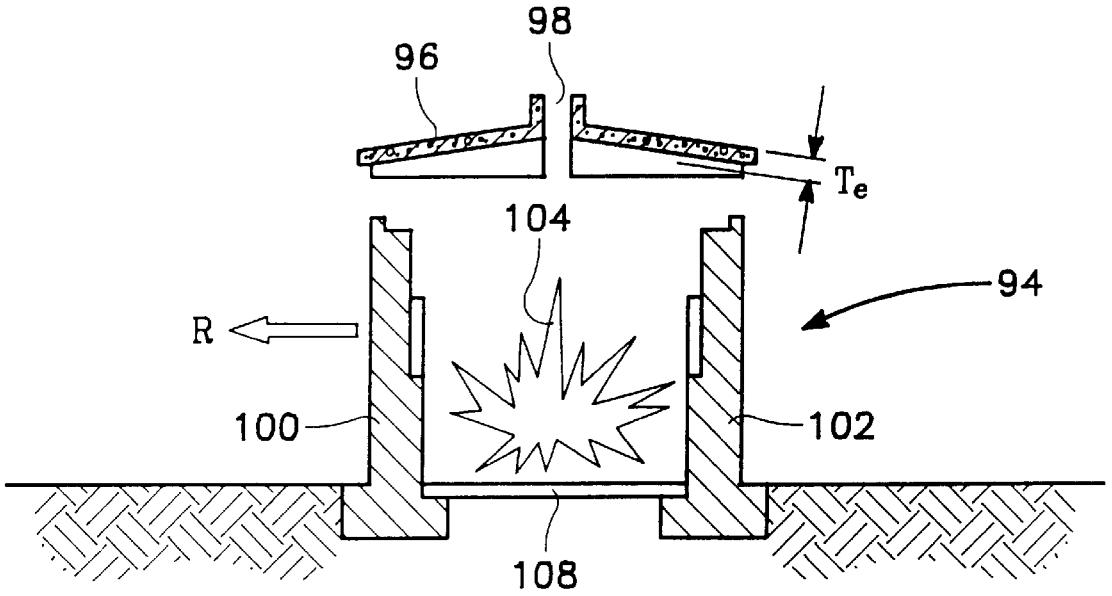

FIG. 5B shows a building 94 comprising a floor 108, upstanding walls 100 and 102 extending from floor 108, and a concrete roof 96 affixed to the top of upstanding walls 100 and 102. Concrete roof 96 includes a chimney vent 98 having a vent area $A_V$=68 $ft^2$. The effective thickness of the concrete roof 96, $T_e$, is 18 inches. Pallets of ordnance stored in building 94 would utilize water-blankets 20 (FIG. 1) to mitigate the gas pressure environment generated inside building 94 by the maximum credible explosion 104. As shown in FIG. 5A, water-blanket 20 substantially reduces the peak gas pressure and total gas impulse generated by the maximum credible explosion 104. This reduction, in turn, reduces the maximum strike range of hazardous roof debris from about 124 feet (without a water-blanket, plot 90 of FIG. 5A) to about 13 feet (with a water-blanket, plot 92 of FIG. 5A). This is equivalent to a 90% reduction in the maximum strike range of hazardous debris.

It should be noted that the shock wave from the maximum credible explosion 104 will aerosolize the water in water-blanket 20, thereby allowing the water to absorb a substantial amount of heat energy in the hot gases of the explosion by changing the aerosolized water mist from a mist state to a vapor state. The capacity of the water to absorb heat energy in the hot gases (and thereby reduce the total gas impulse) depends primarily on the ability of the shock wave to aerosolize the water which, in turn, depends on the configuration and location of the water relative to the configuration and location of the explosive generating the maximum credible explosion.

Figure 6:
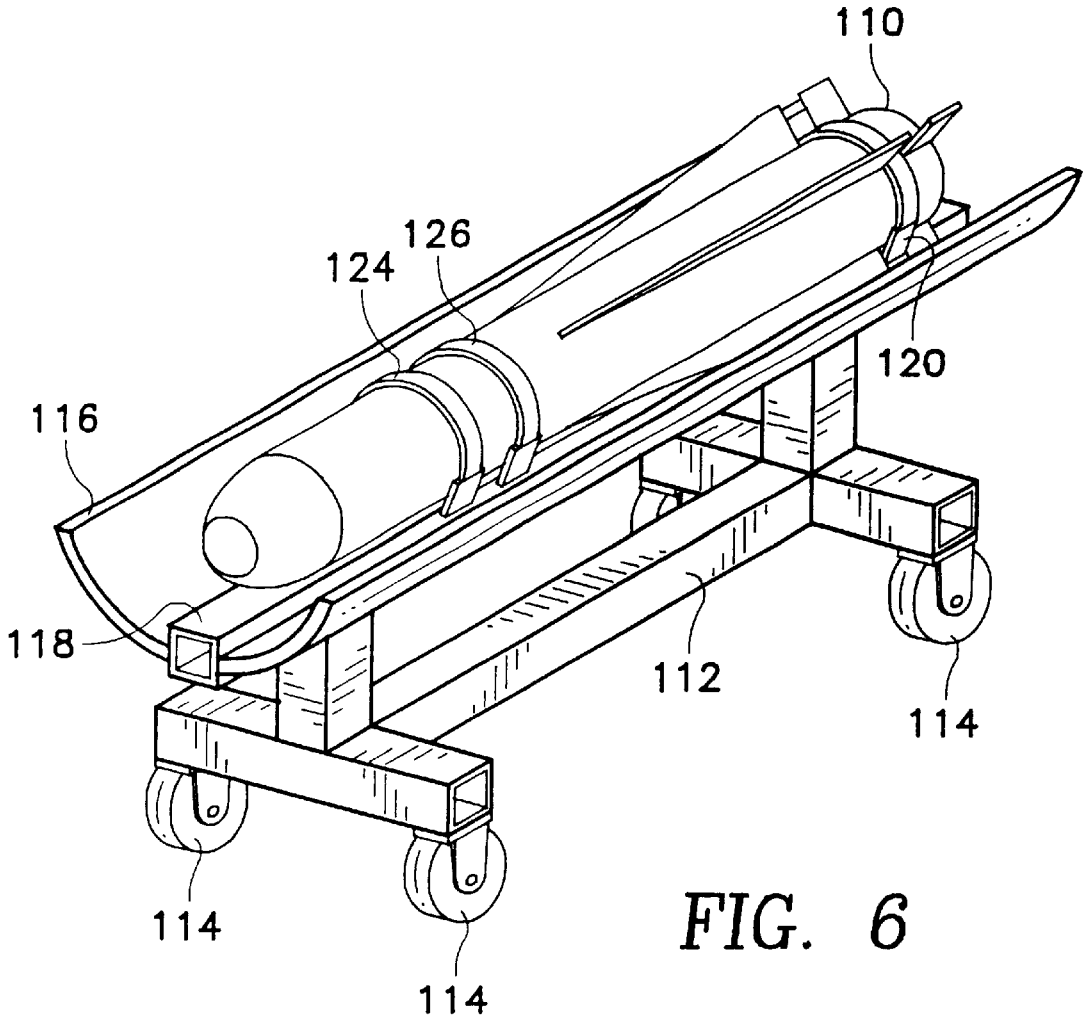
FIG. 6 illustrates a water-filled cradle mattress deployed on a missile assembly and maintenance stand.

FIG. 6 shows a missile assembly and maintenance stand 112 which is used for maintenance of a missile 110. Missile assembly and maintenance stand 112 includes four wheel casters 114 which allow for movement of the missile assembly and maintenance stand 112 from one location to another location within a missile maintenance facility; a main beam assembly 118 upon which missile 110 rests; an AFT trolley and restraining strap 120, a forward trolley (not illustrated), and restraining straps 124 and 126 for securing the missile to the missile assembly and maintenance stand 112. There is also provided a semi-circular shaped water-filled cradle mattress 116 which places water in proximity to the explosive components of the missile, thereby increasing the efficiency of the water to aerosolize and mitigate the gas pressure and associate effects of an accidental missile explosion.

Figure 7:
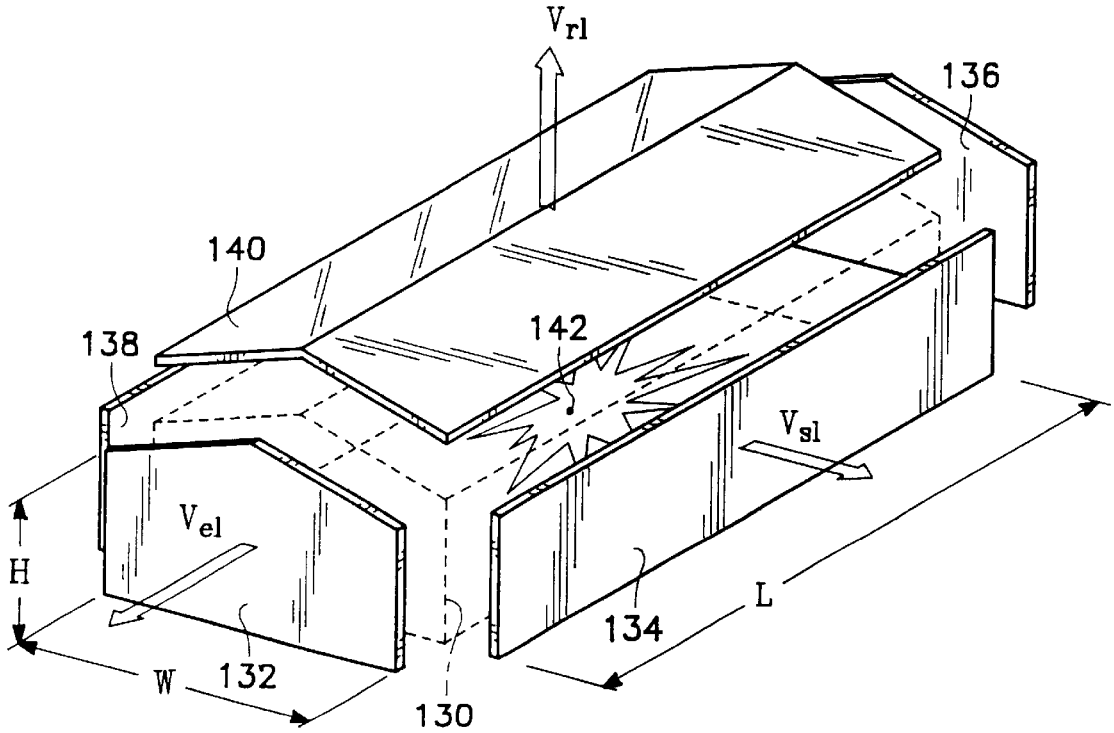
FIG. 7 illustrates a debris prediction model for the trajectory of debris from a building in which an explosion occurs.
Figure 8:
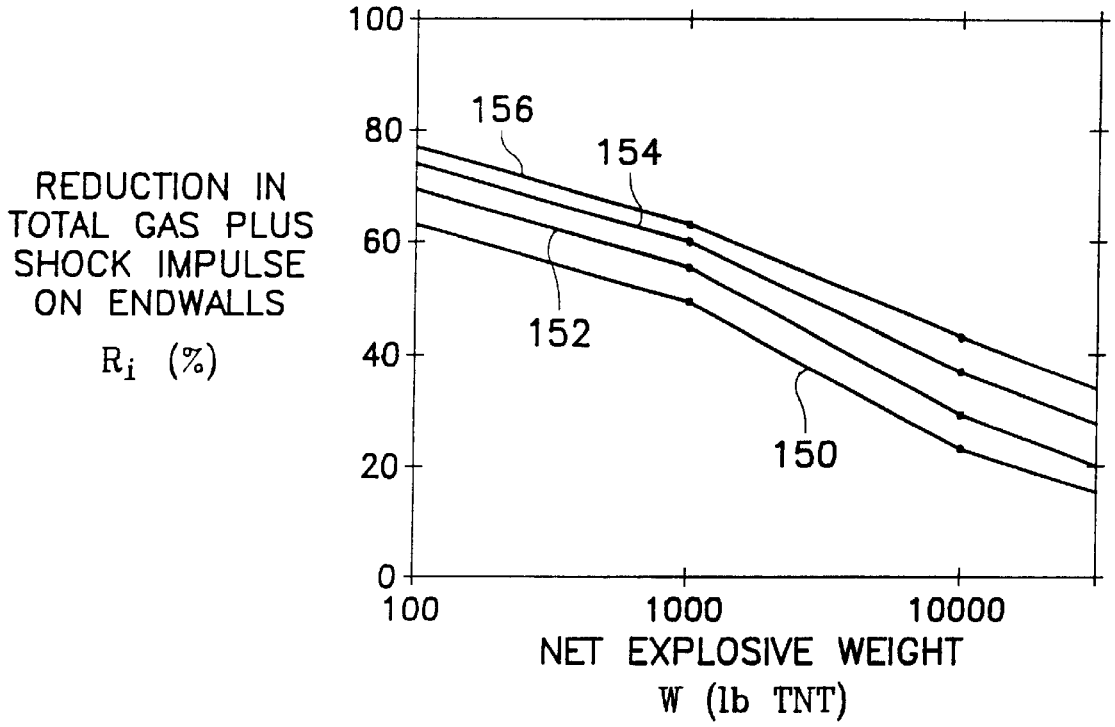
FIG. 8 is a graph illustrating the reduction in total gas plus shock impulse ($i_g+i_s$) acting on the end walls of a building (FIG. 7) resulting from deploying water-filled cradle mattresses, as a function of net explosive weight (W) and weight of building envelope (γ)

FIGS. 6, 7, 8, 9 and 10 show a missile maintenance facility which has four upstanding walls 132, 134, 136 and 138 and a roof assembly 140 mounted on the top of walls 132, 134, 136 and 138. The missile maintenance facility deploys water-filled cradle mattresses 116 of the type illustrated in FIG. 6 to mitigate the effects of an accidental explosion 142 of a missile 110 when maintenance is being performed on the missiles. The building illustrated in FIG. 7 is 100 feet long, 50 feet wide, and 15 feet high. The maximum credible explosion 142 is located at the center of the missile maintenance facility, four feet above the floor of the facility. The unit mass of the building envelope (designated by the reference numeral 130) is $\gamma$ which ranges from 25 psf minimum to 200 psf maximum. FIG. 8 illustrates the reduction in total gas plus shock impulse ($i_g+i_s$) acting on the end walls 132 and 136 of the building if a water-filled cradle mattress 116 is located adjacent to each missile, as a function of net explosive weight W of the maximum credible explosion and the unit weight $\gamma$ of the building's end walls. Plot 156 illustrates the reduction in total gas plus shock impulse on the end walls 132 and 136 if $\gamma$=200 psf; plot 154 illustrates the reduction in total gas plus shock impulse on the end walls 132 and 136 if $\gamma$=100 psf; plot 152 illustrates the reduction in total gas plus shock impulse on the end walls 132 and 136 if $\gamma$=50 psf; and plot 150 illustrates the reduction in total gas plus shock impulse on the end walls 132 and 136 if $\gamma$=25 psf.

Figure 9:
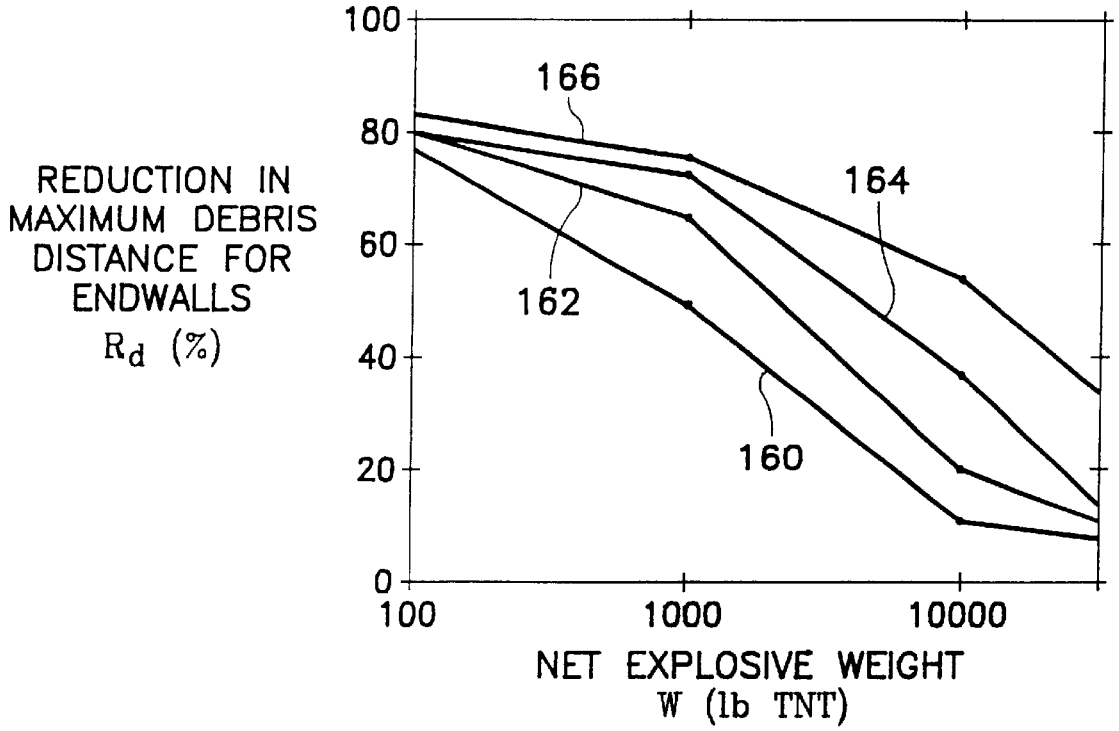
FIG. 9 is a graph illustrating the reduction (%) in the maximum debris distance ($R_d$) from deploying a water-filled cradle mattress, as a function of net explosive weight (W) and unit weight of building envelope (γ)

FIG. 9 illustrates the reduction in maximum debris distance, $R_d$, for end walls 132 and 136 resulting from deploying the water-filled cradle mattresses 116, as a function of net explosive weight, W, and unit weight, $\gamma$, of building's end walls 132 and 136. Plot 166 illustrates the reduction in maximum debris distance, $R_d$, for end walls 132 and 136 for $\gamma$=200 psf; plot 164 illustrates the reduction in maximum debris distance, $R_d$, for end walls 132 and 136 for $\gamma$=100 psf; plot 162 illustrates the reduction in maximum debris distance, $R_d$, for end walls 132 and 136 for $\gamma$=50 psf; and plot 160 illustrates the reduction in maximum debris distance, $R_d$, for end walls 132 and 136 for $\gamma$=25 psf.

Figure 10:
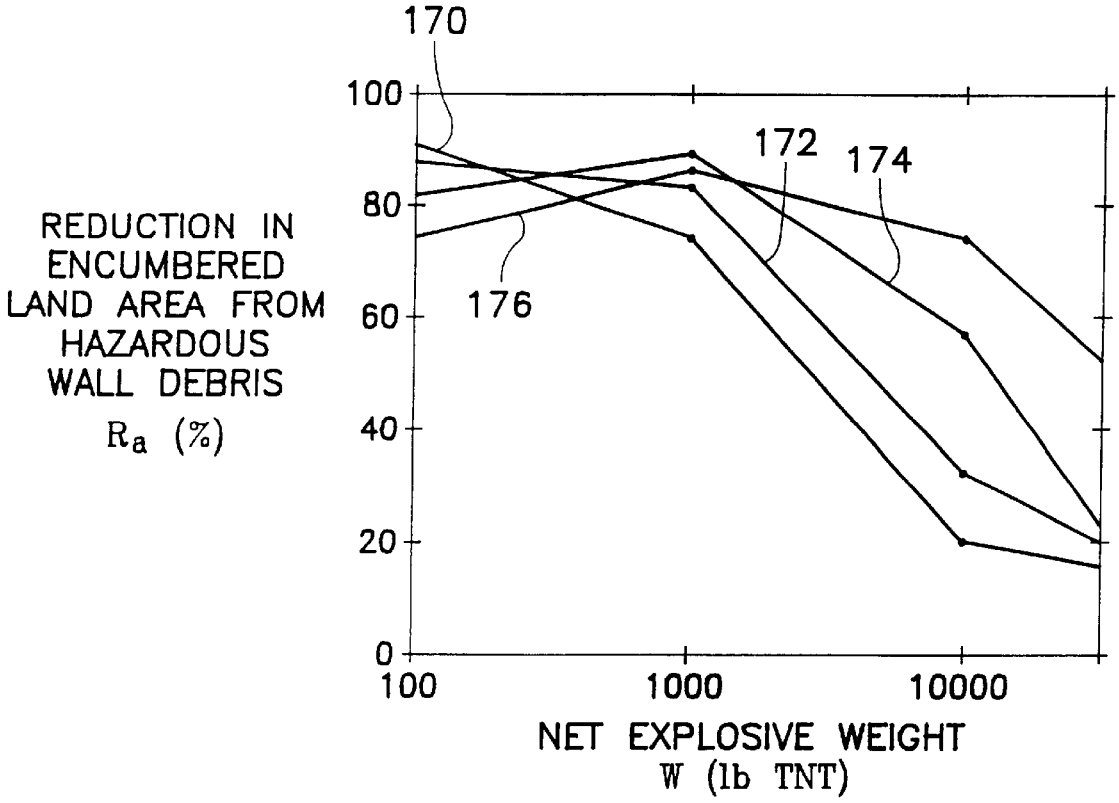
FIG. 10 is a graph illustrating the reduction (%) in encumbered land area ($R_a$) from hazardous wall debris due to the water-filled cradle mattress, as a function of net explosive weight (W) of the MCE and unit weight of building envelope (γ) for the building described in FIG. 7.

FIG. 10 illustrates the reduction in encumbered land area for hazardous wall debris resulting from deploying a water-filled cradle mattress 116 adjacent to each missile in the building, as a function of net explosive weight, W, of the maximum credible explosion and unit weight of the building's walls, $\gamma$. Plot 176 illustrates the reduction in encumbered land area, $R_a$, for hazardous wall debris if $\gamma$=200 psf; plot 174 illustrates the reduction in encumbered land area, $R_a$, for hazardous wall debris if $\gamma$=100 psf; plot 172 illustrates the reduction in encumbered land area, $R_a$, for hazardous wall debris if $\gamma$=50 psf; and plot 170 illustrates the reduction in encumbered land area, $R_a$, for hazardous wall debris if $\gamma$=25 psf. The reduction in encumbered land area, $R_a$, ranges from 75% to 90% for W=100 lbs NEW; from 20% to 75% for W=10,000 lbs NEW; and from 15% to 50% for W=30,000 lbs NEW.

Figure 11:
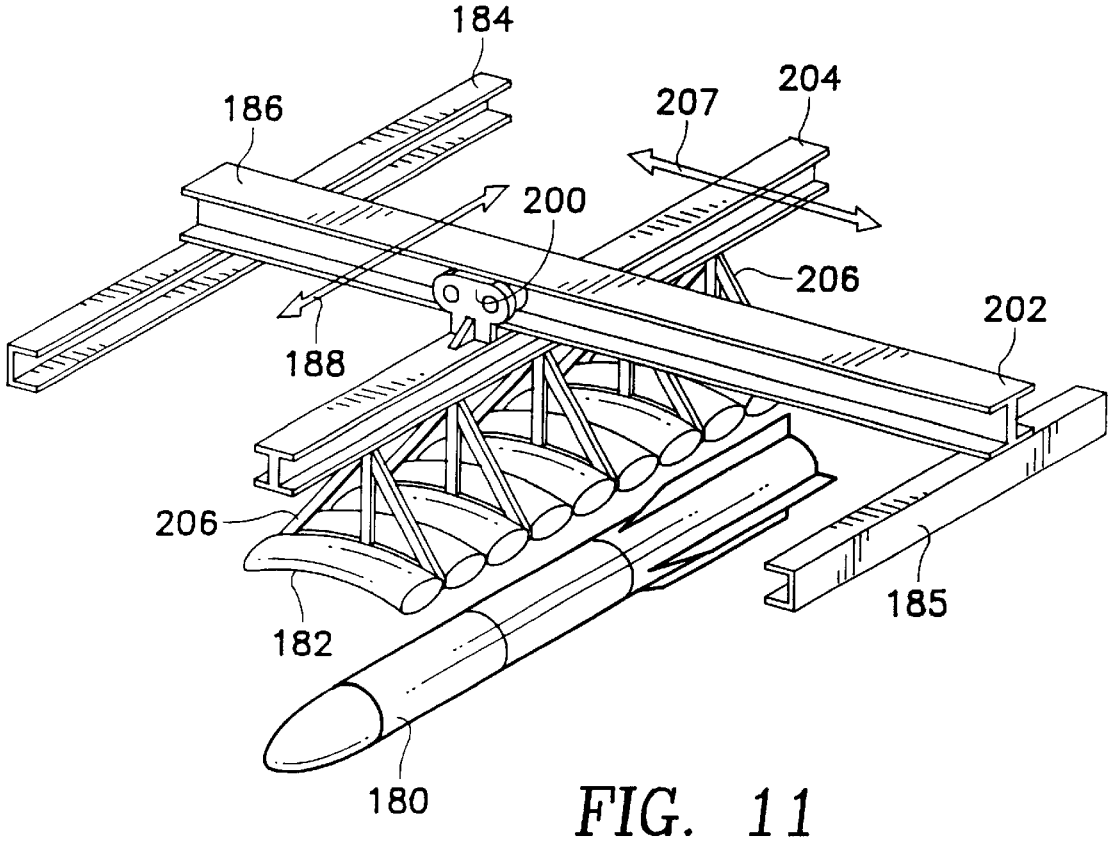
FIG. 11 illustrates a water-pillow which is deployed above a missile during an all-up-round test in a missile test cell.

FIG. 11 shows a water pillow 182 which is deployed above a missile 180 undergoing an all-up-round test in a missile test cell (not illustrated). A bridge crane 202 is used to position and support water pillow 182 over a test restraint fixture (not illustrated) which restrains missile 180 during a missile test. Bridge crane 202 includes two bridge rails 184 and 185 upon which an I-beam 186 rides in the direction indicated by an arrow 188. A carriage 200, which has an I-beam 204 and mattress support structure 206 attached thereto, rides on I-beam 186 in the direction indicated by arrow 207.

Figure 12:
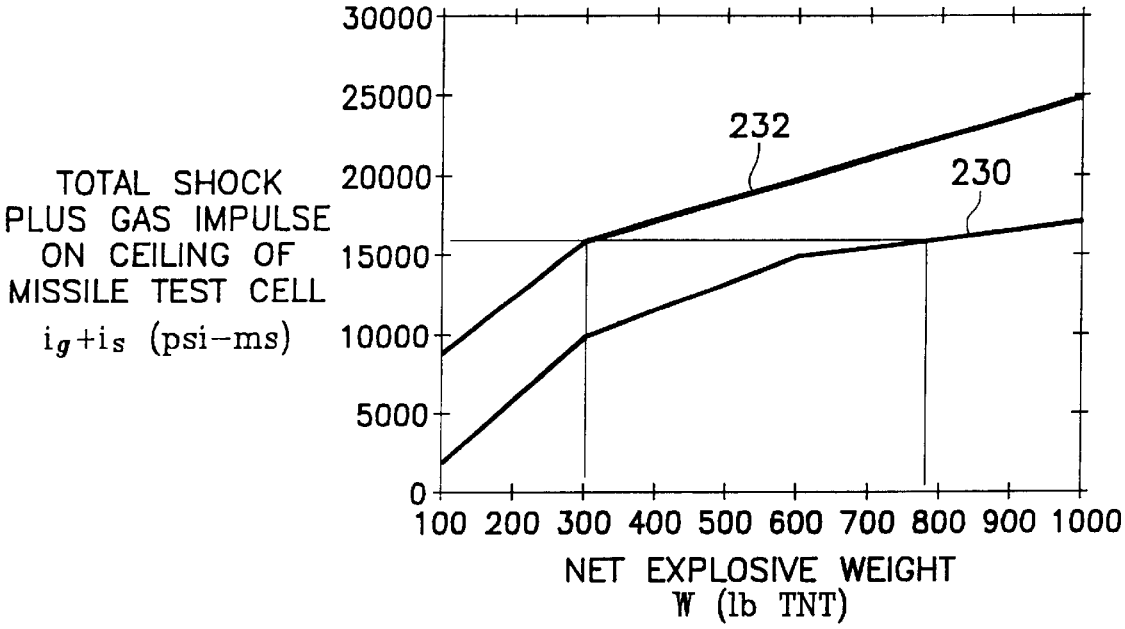
FIG. 12 is a graph illustrating the increase in explosive weight capacity of a missile test cell by deploying the water-pillow shown in FIG. 11.

Referring to FIGS. 11 and 12, FIG. 12 illustrates the increase in the safe explosive weight capacity of a missile test cell by deploying a water pillow 182 over missile 180 during test of the missile 180. Comparing plot 230 (with water pillow 182) and plot 232 (without water pillow 182) shown in FIG. 12, the water pillow 182 reduces the total gas plus shock impulse by about 78% for W=100 lbs NEW; by about 37% for W=300 lbs NEW; and by about 27% for W=1000 lbs NEW. Also, if the safe impulse capacity of the walls and roof of an existing missile test cell is 15,300 psi-msec, as illustrated in FIG. 12, then the safe explosive capacity of the missile test cell is 300 lbs NEW without a water pillow (plot 232, FIG. 12), but the safe explosive capacity of the missile test cell can be increased 163% to 790 lbs NEW (plot 230, FIG. 12) by simply deploying the water pillow 182. This example demonstrates that the water-based apparatus provides a very economical and effective scheme to substantially increase the safe explosive capacity of existing weapons facilities.

Figure 13:
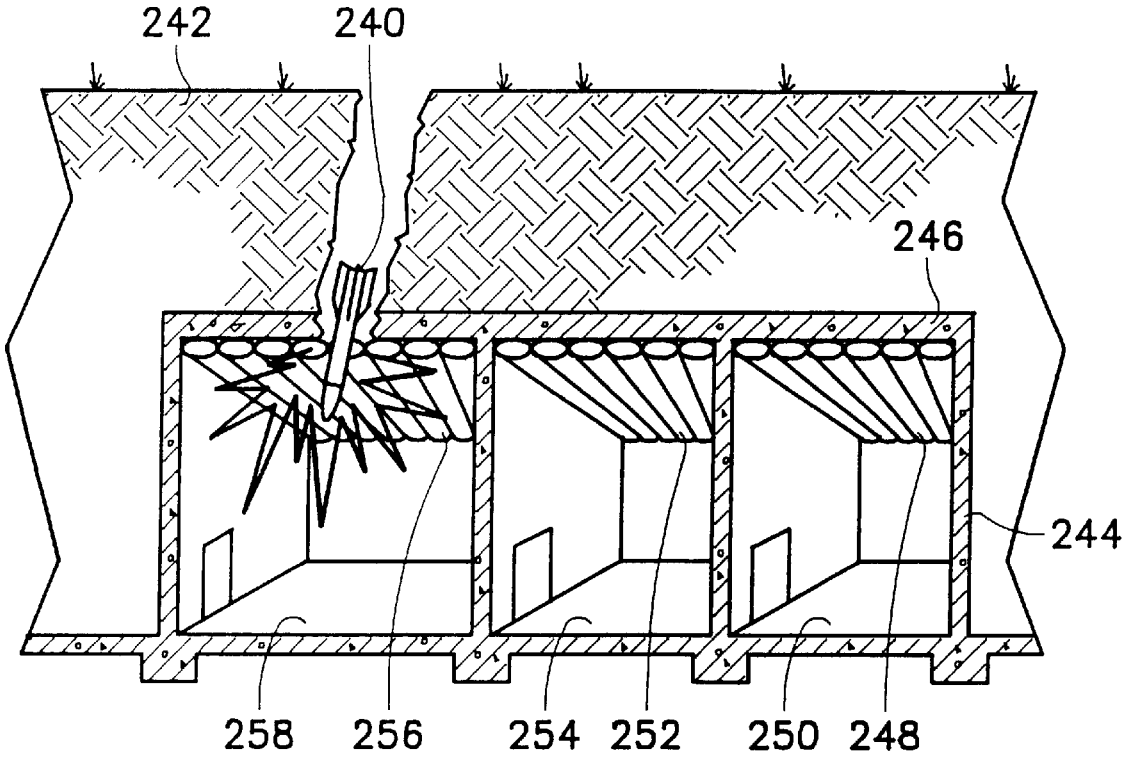
FIG. 13 illustrates a facility wherein water-blankets are suspended from the ceiling of the facility to enhance survivability against a penetrating weapon.

FIG. 13 shows an underground command and control center 244 which has water-blankets 248, 252 and 256 deployed in rooms 250, 254 and 258, respectively, to significantly enhance survivability of the command and control center 244 when the center 244 is under attack by a missile 240 which penetrates the ground 242 and roof 246 and then detonates inside room 258 of the command and control center 244.

When missile 240 carries a 100 pound NEW warhead, each water-blanket 248, 252 and 256 will be required to store about four cubic feet of water to reduce the peak gas pressure and total gas impulse in room 258 by about 90%. A water-blanket six feet long, four feet wide, and two inches thick would provide the required capacity of four cubic feet. The 90% reduction in total gas impulse now makes it practical and cost effective to blast harden the walls of each room, thereby limiting damage and injuries to the room penetrated by the missile.

Figure 14:
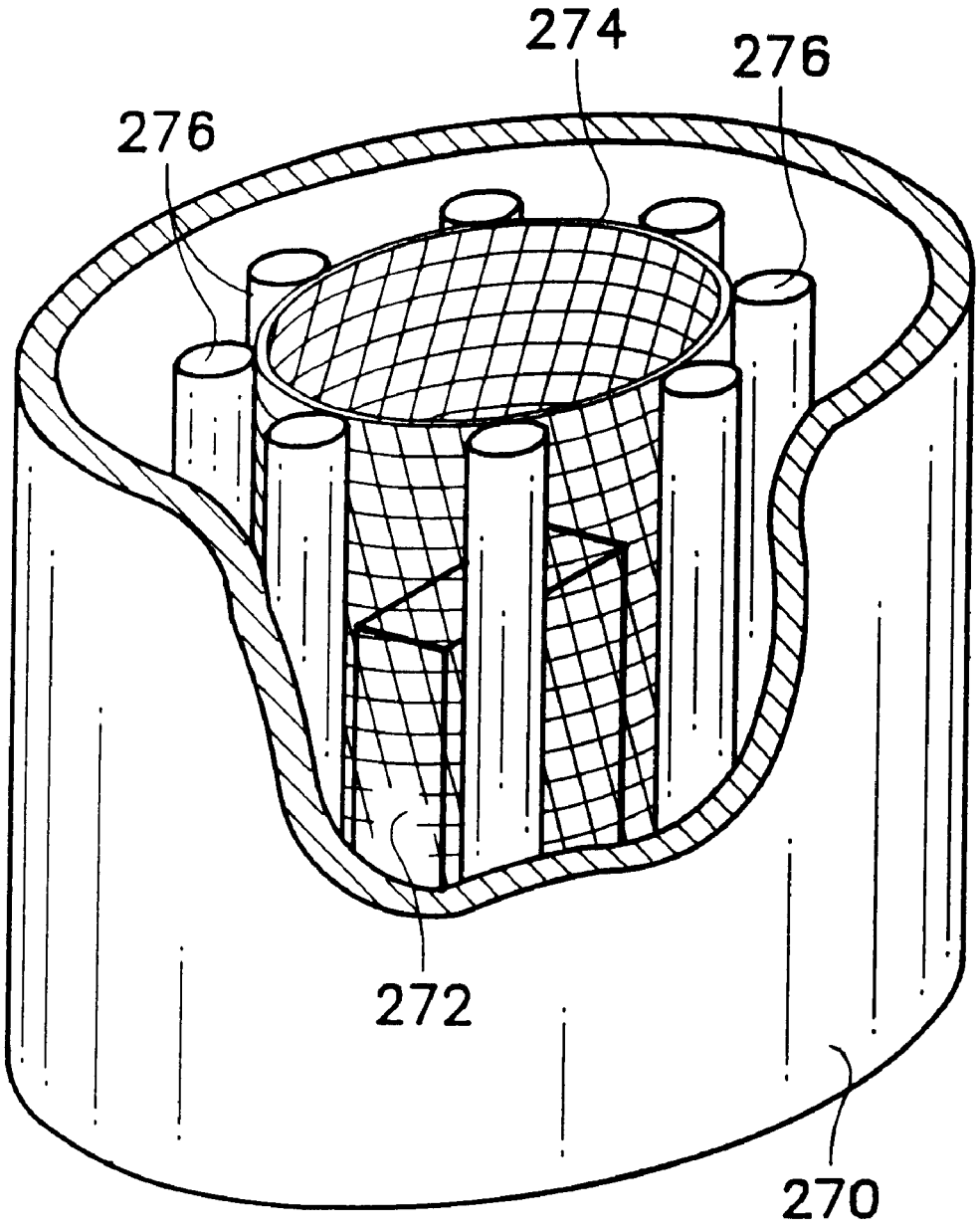
FIG. 14 illustrates a mobile bomb containment vessel enclosing a bomb basket wherein tubes of water are suspended from the outer rim of the bomb basket which contains explosives/bombs.

FIG. 14 shows a mobile bomb containment vessel 270 which is designed to fully contain the explosion effects from an explosive device 272 if the device 272 were to detonate inside the vessel 270. Located inside vessel 270 is a bomb basket 274 fabricated from wire screen. Explosive device 272 is carried in basket 274 which holds explosive device 272 at a safe standoff distance from containment vessel 270. Cylindrical water containers 276 are uniformly spaced along the outer perimeter of basket 274 and affixed thereto. When an explosion occurs inside vessel 270, shock waves from the explosion aerosolize the water stored in the water containers 276, thereby reducing the peak gas pressure and total gas impulse from the explosion by about 90% within vessel 270. This 90% reduction in total gas impulse makes it possible to reduce the cost of the containment vessel shell 270, or, alternatively, to increase significantly the safe explosive weight capacity of an existing mobile bomb containment vessel 270.

From the foregoing, it is readily apparent that the present invention comprises a new, unique, and exceedingly useful water-based apparatus for mitigating the effects from a fully or partially confined explosion. This water-based apparatus constitutes a considerable improvement over the known prior art. Many modifications and variations of the present invention are possible in light of the above teachings. It is to be understood that within the scope of the appended claims the invention may be practiced otherwise than as specifically described.

What is claimed is:

1. A method of shielding a given location from the effects of a detonation of an explosive material comprising the steps of:

(a) placing a first fluid storage module on an upper portion of said explosive material;

(b) placing a second fluid storage module on the upper portion of said explosive material;

(c) coupling said first fluid storage module to said second fluid storage module to form a unitary structure which is positioned on the upper portion of said explosive material;

(d) filling said first fluid storage module and said second fluid storage module with a liquid;

(e) allowing said liquid within said first fluid storage module and said second fluid storage module to absorb a substantial amount of heat energy generated by hot gases from the detonation of said explosive material, wherein each of said first and second fluid storage modules include:

(i) first, second, third, fourth and fifth fluid storage compartments, each of said first, second, third, fourth and fifth fluid storage compartments having a chamber formed therein for storage of said liquid;

(ii) a plurality of fluid passageways, a pair of said plurality of fluid passageways connecting the chamber of one of said first, second, third, fourth and fifth fluid storage compartments to the chamber of an adjacent one of said first, second, third, fourth and fifth fluid storage compartments to allow for transfer of said liquid between the chambers of adjacent fluid storage compartments; and (iii) a stem communicating with and extending from the chamber of said first fluid storage compartment, said stem allowing said liquid to be supplied to the chambers of said first, second, third, fourth and fifth fluid storage compartments within said first and second fluid storage modules, said stem also allowing said liquid to be drained from the chambers of said first, second, third, fourth and fifth fluid storage compartments within said first and second fluid storage modules; and (iv) a plurality of handles, a first pair of said plurality of handles being attached to one side of each of said first and second fluid storage modules and a second pair of said plurality of handles being attached to an opposite side of each of said first and second fluid storage modules; and (f) reducing a maximum strike range of hazardous debris from a structure containing said explosive material from about 124 feet to about 13 feet, resulting in a reduction of a maximum strike range of said hazardous debris by about 90%.

2. The method of claim 1 further comprising the step of changing an aerosolized liquid mist generated by said liquid during the detonation of said explosive material from a mist state to a vapor state to reduce the maximum strike range of said hazardous debris.

3. The method of claim 1 wherein said first and second fluid storage modules include a zipper affixed thereto, said zipper being adapted to couple said first fluid storage module to said second fluid storage module and to uncouple said first fluid storage module from said second fluid storage module.

4. The method of claim 1 wherein said unitary structure comprises a water blanket which is about six feet long, about four feet wide, and about two inches thick.

5. The method of claim 4 wherein said unitary structure has a fluid storage capacity of about four cubic feet.

6. A method of shielding a given location from the effects of a detonation of an explosive material comprising the steps of:

(a) placing a first water storage module on an upper portion of said explosive material;

(b) placing a second water storage module on the upper portion of said explosive material;

(c) coupling said first water storage module to said second water storage module to form a water blanket which is positioned on the upper portion of said explosive material to cover said explosive material, said first and second water storage modules including a zipper affixed thereto, said zipper being utilized to couple said first water storage module to said second water storage module;

(d) filling said first water storage module and said second water storage module with water;

(e) allowing the water within said first water storage module and said second water storage module to absorb a substantial amount of heat energy generated by hot gases from the detonation of said explosive material, wherein each of said first and second water storage modules include:

(i) first, second, third, fourth and fifth water storage compartments, each of said first, second, third, fourth and fifth water storage compartments having a chamber formed therein for storage of the water;

(ii) a plurality of water passageways, a pair of said plurality of water passageways connecting the chamber of one of said first, second, third, fourth and fifth water storage compartments to the chamber of an adjacent one of said first, second, third, fourth and fifth water storage compartments to allow for transfer of the water between the chambers of adjacent water storage compartments; and (iii) a stem communicating with and extending from the chamber of said first water storage compartment, said stem allowing the water to be supplied to the chambers of said first, second, third, fourth and fifth water storage compartments within said first and second water storage modules, said stem also allowing the water to be drained from the chambers of said first, second, third, fourth and fifth water storage compartments within said first and second water storage modules; and (iv) a plurality of handles, a first pair of said plurality of handles being attached to one side of each of said first and second water storage modules and a second pair of said plurality of handles being attached to an opposite side of each of said first and second water storage modules; and (f) reducing a maximum strike range of hazardous debris from a structure containing said explosive material from about 124 feet to about 13 feet, resulting in a reduction of a maximum strike range of said hazardous debris by about 90%.

7. The method of claim 6 further comprising the step of changing an aerosolized water mist generated by the water during the detonation of said explosive material from a mist state to a vapor state to reduce the maximum strike range of said hazardous debris.

8. The method of claim 6 wherein said water blanket is about six feet long, about four feet wide, and about two inches thick.

9. The method of claim 6 wherein said water blanket has a water storage capacity of about four cubic feet.

10. The method of claim 6 wherein said water blanket requires about 1.8 pounds of water for each pound of said explosive material said water blanket covers whenever said explosive material comprises a TNT explosive.

11. The method of claim 6 wherein said water blanket requires about 3.8 pounds of water for each pound of said explosive material said water blanket covers whenever said explosive material comprises an H-6 high explosive.

* * * * *